US008360236B2

(12) United States Patent
Young et al.

(10) Patent No.: US 8,360,236 B2
(45) Date of Patent: Jan. 29, 2013

(54) GOLF BALL CARRIER WITH GOLF BALL RELEASE TAB

(76) Inventors: Michael Young, Wichita, KS (US); Gordon Arthur Young, Wichita, KS (US); Richard Bloomer, Clearwater, KS (US)

( * ) Notice: Subject to any disclaimer, the term of this patent is extended or adjusted under 35 U.S.C. 154(b) by 252 days.

(21) Appl. No.: 12/844,032

(22) Filed: Jul. 27, 2010

(65) Prior Publication Data

US 2012/0024915 A1 Feb. 2, 2012

(51) Int. Cl.
*B65D 85/00* (2006.01)

(52) U.S. Cl. ..... 206/315.9; 294/19.2; 221/307; 221/199

(58) Field of Classification Search ..... 206/315.1, 206/315.9; 221/303, 306, 307, 199, 285; 294/19.2, 99.1
See application file for complete search history.

(56) References Cited

U.S. PATENT DOCUMENTS

| | | | | |
|---|---|---|---|---|
| 5,147,101 | A * | 9/1992 | Tiller | 294/19.2 |
| 5,667,082 | A * | 9/1997 | Hamilton et al. | 211/15 |
| 6,739,477 | B1 * | 5/2004 | Pascual | 221/199 |
| 7,398,888 | B1 * | 7/2008 | Nowak | 211/59.2 |
| 2004/0094565 | A1 * | 5/2004 | Bosanac | 221/247 |
| 2007/0163903 | A1 * | 7/2007 | Howard | 206/315.9 |

* cited by examiner

*Primary Examiner* — Jacob K Ackun
(74) *Attorney, Agent, or Firm* — Hovey Williams LLP

(57) ABSTRACT

A ball carrier having a hollow tubular support member for holding a plurality of balls stacked axially therein and a ball release tab configured to release one ball at a time from an open end of the hollow tubular support member. The ball release tab may have a first stopper portion, a second stopper portion, and a manipulation portion. The ball release tab may be biased in a first position in which the first stopper portion impedes exit of the balls and may be actuated via the manipulation portion to a second position in which the first portion is rotated away from the balls and the second stopper portion impedes exit of the balls. When the ball release tab moves from the second position to the first position, the second stopper portion rotates away from the balls, allowing the ball resting on the second stopper portion to drop out of the ball carrier, while the first stopper portion rotates back toward the balls, impeding the next ball from dropping out of the ball carrier.

4 Claims, 6 Drawing Sheets

GOLF BALL CARRIER WITH GOLF BALL RELEASE TAB

BACKGROUND

1. Field

The present invention relates to a ball carrier with a ball release tab for retaining and releasing golf balls from the ball carrier.

2. Related Art

Golfers may store and/or carry golf balls with a variety of golf ball holders or combination golf ball/golf club carriers. Specifically, a tube-like holder or carrier having a diameter equal to or greater than the diameter of a golf ball may be used, such that the golf balls can be stored therein, one on top of each other. This configuration can prevent the balls from rolling around in all directions within the carrier or holder.

In this configuration, the diameter of the tube-like holder is typically not large enough for the golfer to fit their hands or fingers therein to retrieve a golf ball. Thus, to retrieve a golf ball, the holder or carrier may be tilted such that gravity causes the golf balls to slide toward and out through an open end of the tube. However, releasing only one golf ball at a time from the tube-like holder or carrier in this manner can be difficult, since gravity causes all of the golf balls, stacked on top of each other, to move toward the open end.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

The present invention solves some of the above-described problems and provides a distinct advance in the art of golf ball carriers. One embodiment of the invention comprises a golf ball carrying apparatus having a hollow tubular support member configured to hold golf balls therein and a golf ball release tab shiftably attached to the hollow tubular support member proximate an open end of the hollow tubular support member.

The golf ball release tab may be normally biased in a first position to impede the golf balls within the hollow tubular support from sliding out through the open end thereof. The golf ball release tab may be actuated outward to a second position and then allowed to return to its original first position to release a pre-determined number of golf balls, such as one golf ball, at a time from the hollow tubular support member. The golf ball release tab may be biased with a resilient member, such as a spring, and/or may be configured such that at least a portion of the golf ball release tab is, itself, a resilient member.

BRIEF DESCRIPTION OF THE DRAWINGS

Embodiments of the present invention are described in detail below with reference to the attached drawing figures, wherein.

Figure 1:
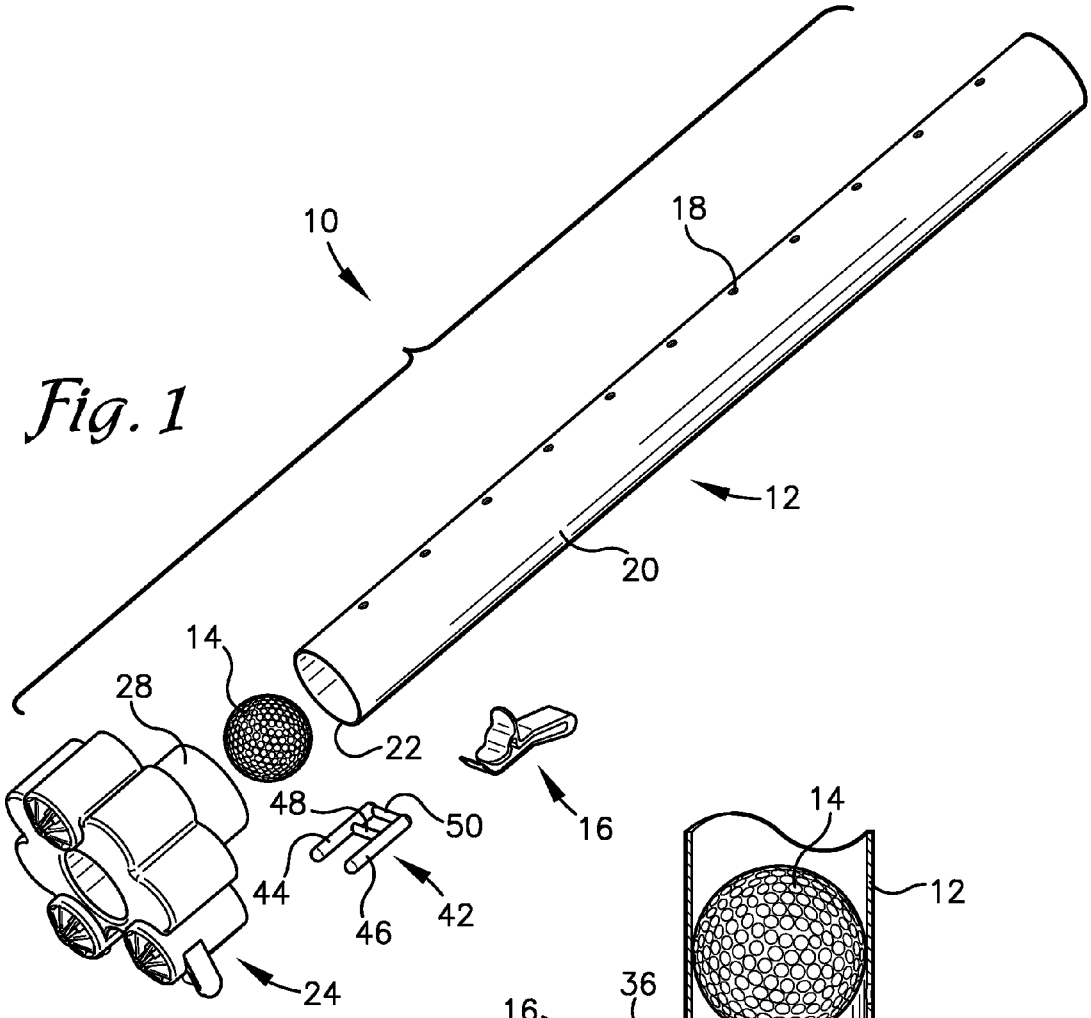
FIG. 1 is a perspective view of a golf ball carrying apparatus constructed according to an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The present invention, as illustrated in FIG. 1, is a ball carrying apparatus 10 having a hollow tubular support member 12 configured for housing a plurality of balls 14 therein and a ball release tab 16 shiftably attached relative to the hollow tubular support member 12. The ball release tab 16 is normally biased to retain the balls 14 within the hollow tubular support member 12 and may be manipulated to release the balls 14 from within the hollow tubular support member 12 in groups of one or more at a time. The balls 14 may be golf balls, tennis balls, ping-pong balls, baseballs, or other types of balls, round objects, or objects of any shape.

The hollow tubular support member 12 may be made of plastic, metal, wood, and/or the like. For example, the tubular support member 12 may be composed of ABS or acetal. In some embodiments of the invention, the hollow tubular support member 12 may be the hollow tubular support member of the light weight golf club carrying apparatus described in U.S. patent application Ser. No. 12/719,522, incorporated herein in its entirety. However, the hollow tubular support member 12 may be any hollow storage bin for holding a plurality of objects.

The tubular support member 12 may be sized and shaped to hold the plurality of balls 14 therein. In some embodiments of the invention, the hollow tubular support member 12 may be substantially cylindrical, having a diameter equal to or slightly greater than a diameter of one of the balls 14. One or more holes 18 may be formed in the hollow tubular support member 12 to allow a golfer or user to visually determine how many balls 14 are held therein. Alternatively, a clear or translucent material may be used to construct the hollow tubular support member 12. The hollow tubular support member 12 may also have one or more sidewalls 20 and at least one open end 22 sized and shaped to allow the balls 14 to enter and/or exit the hollow tubular support member 12 there through.

In some embodiments of the invention, a sidewall opening (not shown) may be formed in the sidewall 20 of the tubular support member 12 at or proximate the open end 22. At least a portion of the ball release tab 16 may extend through the sidewall opening. Alternatively or additionally, the golf ball carrying apparatus 10 may further comprise a base 24 that may be attached to and extend from the tubular support member 12 at or proximate the open end 22. The base 24 may be configured such that the ball release tab 16 may be pivotally and/or resiliently attached thereto.

Figure 8:
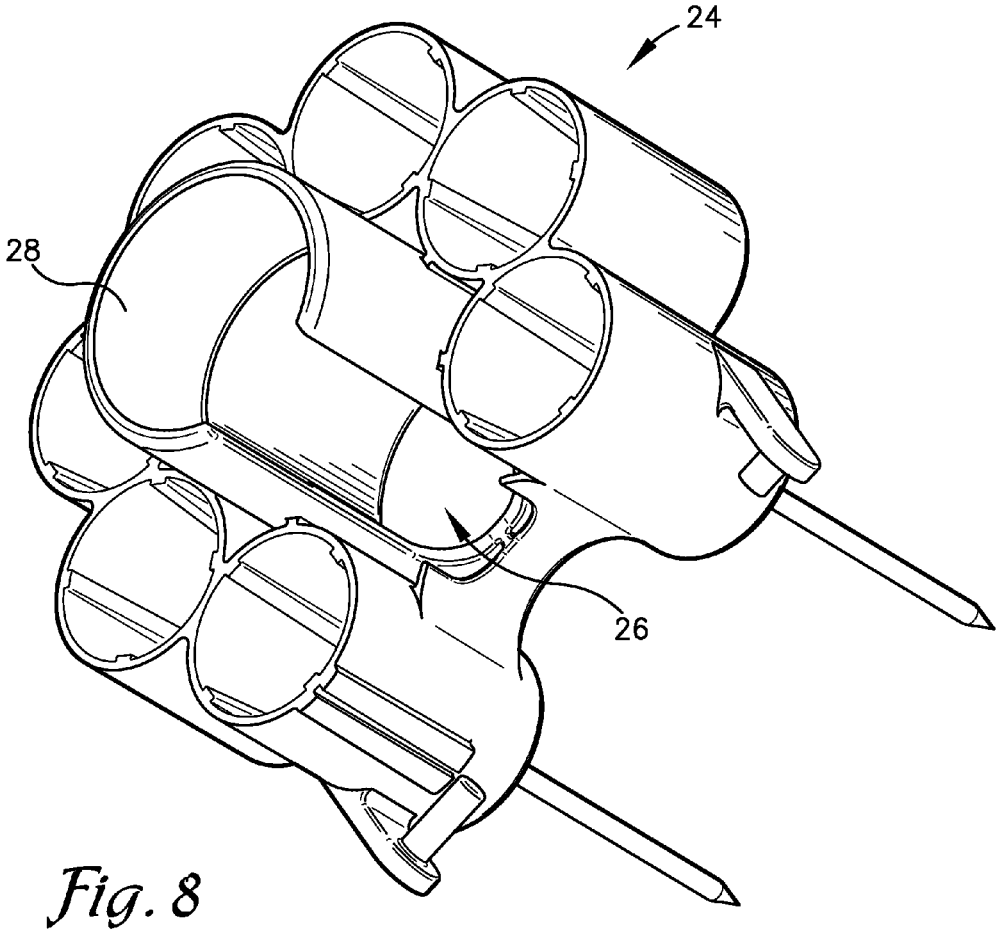
FIG. 8 is a perspective view of a base of the golf ball carrying apparatus of FIG. 1.

In some embodiments of the invention, the base 24 may include an opening 26 formed into a side of a hollow central tube 28 having two open ends, as illustrated in FIG. 8 herein. The hollow central tube 28 may be axially aligned with the hollow tubular support member 12. Thus, the balls 14 may enter through one end and exit through an opposite end of the hollow central tube 28. In some embodiments of the invention, the base 24 may be integrally formed with the hollow tubular support member.

Furthermore, in some embodiments of the invention, the base 24 may be the club holder lower base described and illustrated in U.S. patent application Ser. No. 12/719,522. Additionally, the ball release tab 16 as described herein may replace the manipulation tab of the light-weight golf club carrying apparatus described in U.S. patent application Ser. No. 12/719,522. Thus, at least a portion of the ball release tab 16 described herein may extend into and be retracted out through the opening formed in a side of the hollow central tube of the club holder lower base.

Figure 2:
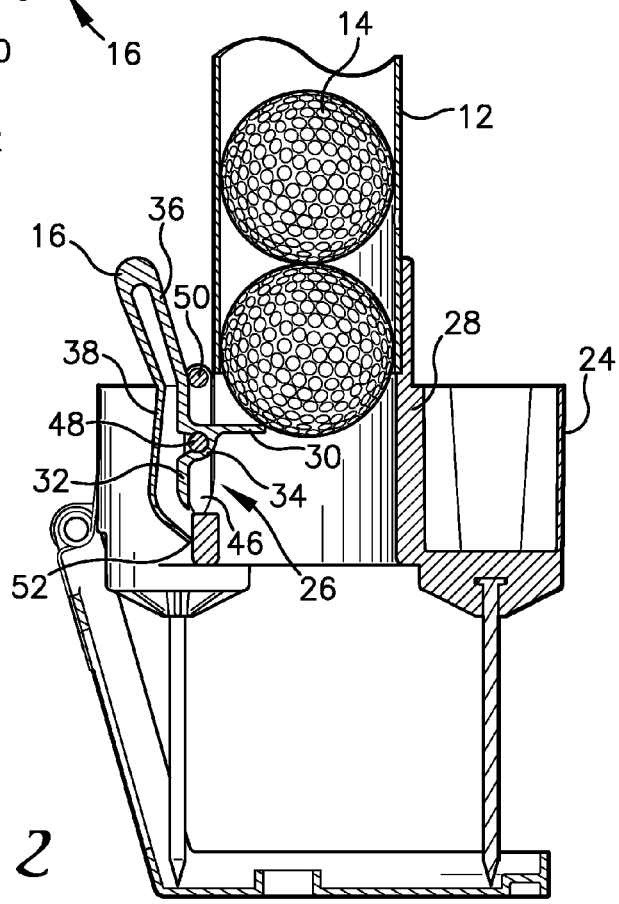
FIG. 2 is a fragmentary cross-sectional view of the golf ball carrying apparatus of FIG. 1, with a golf ball release tab oriented in a first position.
Figure 3:
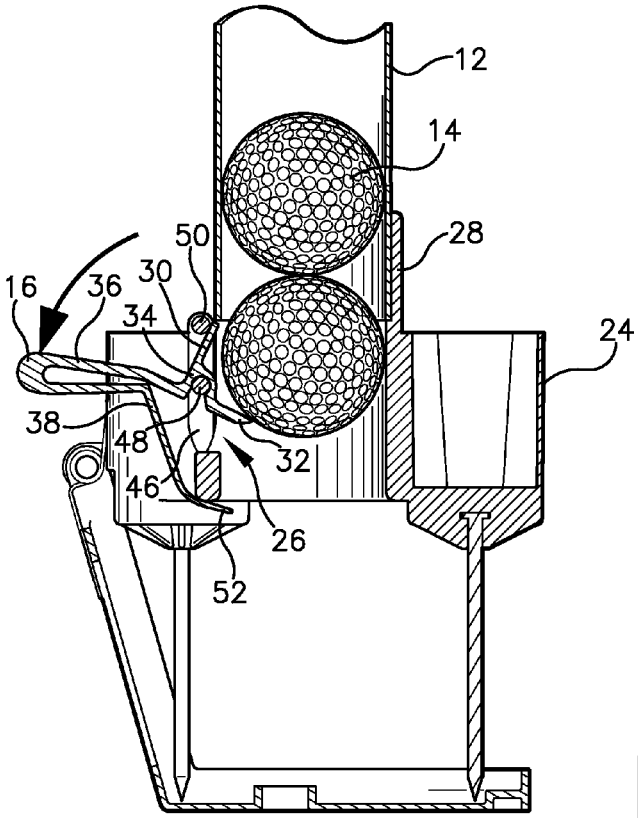
FIG. 3 is a fragmentary cross-sectional view of the golf ball carrying apparatus of FIG. 1, with the golf ball release tab oriented in a second position.
Figure 4:
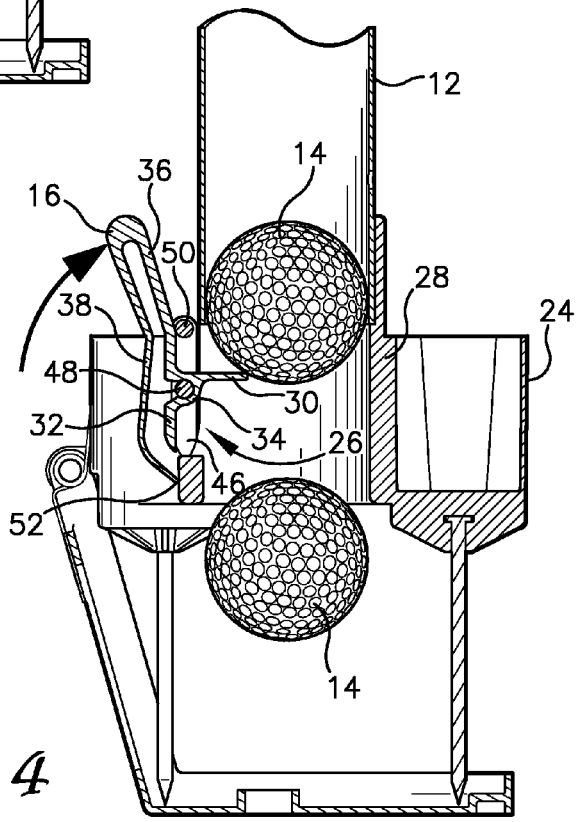
FIG. 4 is a fragmentary cross-sectional view of the golf ball carrying apparatus of FIG. 1, with the golf ball release tab released from the second position back to the first position, thereby dropping a golf ball out of the golf ball carrying apparatus.
Figure 5:
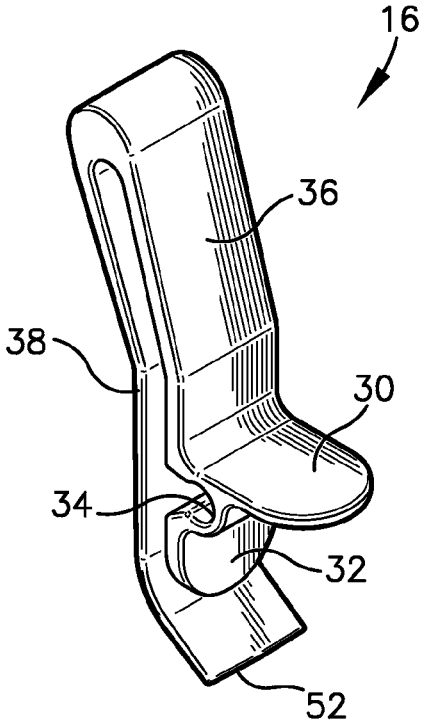
FIG. 5 is a perspective view of the golf ball release tab of the golf ball carrying apparatus of FIG. 1.

The ball release tab 16 may be made of plastic, metal, wood, and/or the like. For example, the ball release tab 16 may be composed of acetal or ABS. The ball release tab 16 may be biased to impede the balls 14 within the hollow tubular support member 12 from sliding out through the open end 22 thereof. The ball release tab 16 may also be actuated or manipulated to release a pre-determined number of balls 14 at a time from within the tubular support member 12. For example, to dispense one ball from the tubular support member 12, a golfer or user of the ball carrying apparatus 10 may actuate the ball release tab from a first position (as illustrated in FIG. 2) to a second position (as illustrated in FIG. 3), and then release the ball release tab 16 (as illustrated in FIG. 4), allowing it to return to its first position.

As illustrated in FIGS. 1-5 and 7, the ball release tab 16 may include a first stopper portion 30, a second stopper portion 32, a pivot joint 34, and a manipulation portion 36. The first stopper portion 30, the second stopper portion 32, and the manipulation portion 36 may extend outward from the pivot joint 34 in different directions from each other. In some embodiments of the invention, the first stopper portion 30 and the second stopper portion 32 may extend at approximately 90-degree angles relative to each other. Furthermore, in some embodiments of the invention, the second stopper portion 32 is located lower relative to the tubular support member 12 than the first stopper portion 30. The ball release tab 16 may further include a restraining portion 38 and/or a biasing spring 40 to bias the ball release tab 16 in the first position.

The first stopper portion 30 may be naturally biased in the first position to extend into or proximate the open end 22 such that the first stopper portion 30 impedes the balls 14 from sliding out through the open end 22. For example, the first stopper portion 30 may extend in and be withdrawn out through the sidewall opening and/or the opening 26 formed in the hollow central tube 28 of the base 24. The second stopper portion 32 fixed relative to the first stopper portion 30 may be naturally biased in the first position to not impede the balls 14 from sliding out through the open end 22. The second stopper portion 32 may also extend through and be withdrawn out through the sidewall opening and/or the opening 26 formed in the hollow central tube 28 of the club holder lower base 24.

The pivot joint 34 may be configured to pivotally attach to the hollow tubular support member 12, the base 24, or another component fixed relative to the hollow tubular support member 12 or the base. For example, the pivot joint 34 may have a c-shaped cross section to at least partially wrap around and thereby rotate about a rod or other similar components described herein. In other embodiments of the invention, the pivot joint 34 may be substantially cylindrical, such that a rod may be inserted therethrough. However, the pivot joint 34 may have any configuration and may shiftably, pivotally, or rotatably attach to the hollow tubular support member 12 and/or the base 24 using any method known in the art.

Figure 6:
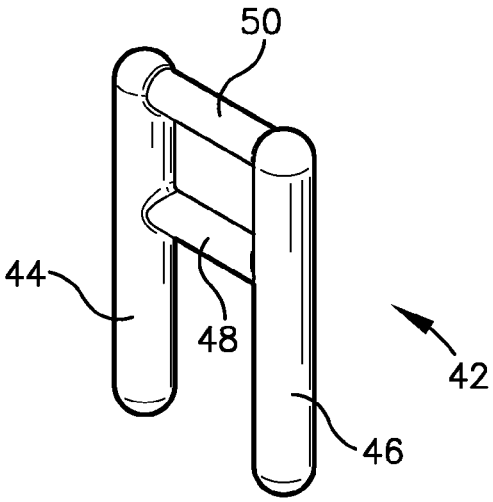
FIG. 6 is a perspective view of a ladder of the golf ball carrying apparatus of FIG. 1 to which the golf ball release tab is rotatably attached.
Figure 7:
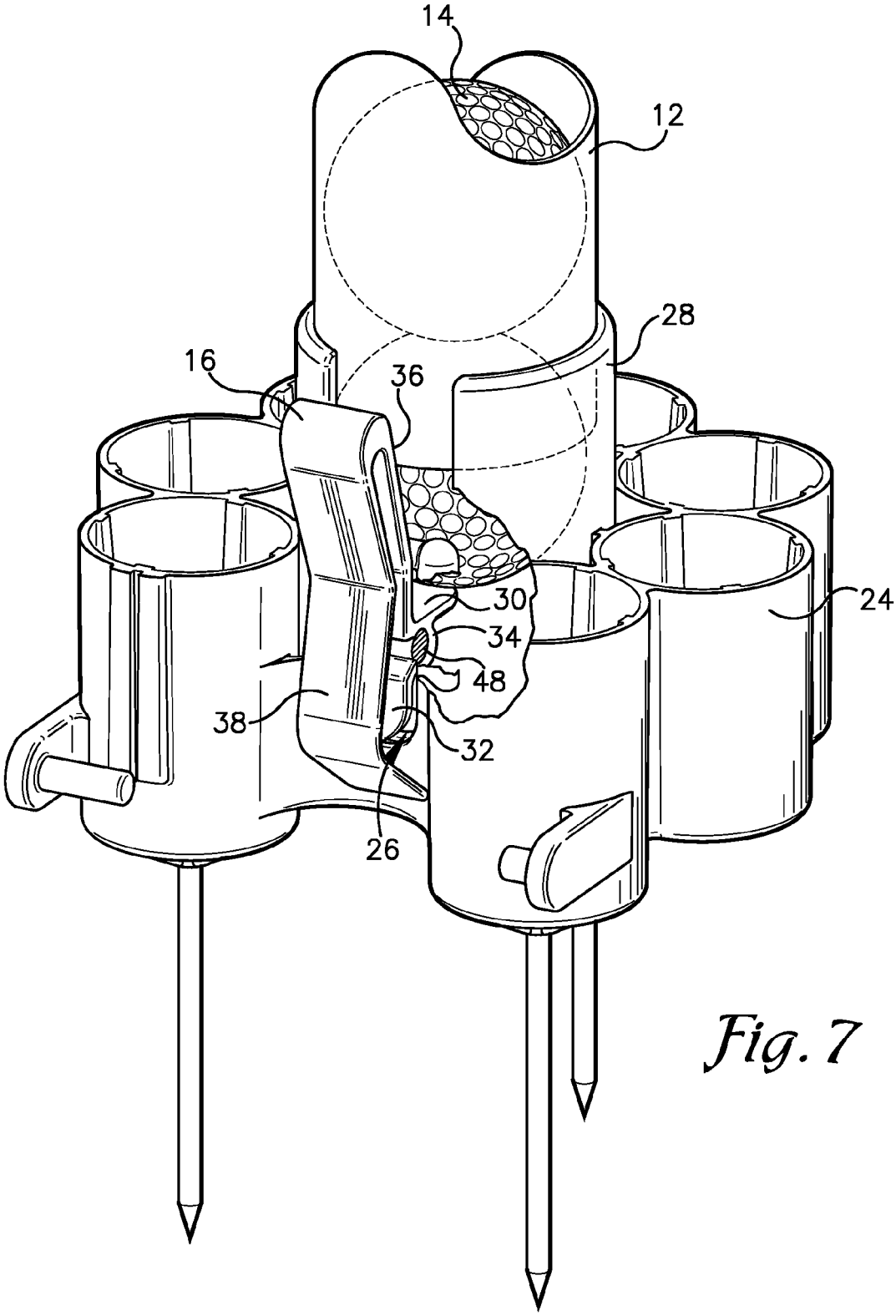
FIG. 7 is a fragmentary perspective view of the golf ball carrying apparatus of FIG. 1.

In some embodiments of the invention, the golf ball carrying apparatus 10 may comprise a ladder 42 to which the pivot joint 34 may be pivotally attached. The ladder 42, as illustrated in FIGS. 1 and 6, may comprise two vertical portions 44,46 spaced apart from each other and joined together by at least one lateral portion 48,50. The ball release tab 16 may pivot about one of the lateral portions 48, while another of the lateral portions 50 may be positioned to limit outward movement of the first stopper portion 30 of the ball release tab 16. The lateral portions 48,50 and/or the vertical portions 44,46 may be shaped like solid or hollow cylinders or may have any desired elongated shape. The ladder 42 may be substantially fixed relative to the base 24 and/or the hollow tubular support member 12. For example, the vertical portions 44,46 of the ladder 42 may be slid into two openings (not shown) or cylinders formed in the base 24 or club holder lower base.

The manipulation portion 36 may be configured to be manipulated by the golfer or user to release one or more balls 14 from the golf ball carrying apparatus 10. In some embodiments of the invention, the manipulation portion 36 may extend outward and/or angle slightly upward and away from the hollow tubular support member 12 in the first position (as illustrated in FIG. 2) and may be operable to be pulled in an outward direction away from the hollow tubular support member 12, moving the ball release tab 16 into the second position (as illustrated in FIG. 3).

The restraining portion 38 may be attached to and extend from the manipulation portion 36. The restraining portion 38 may have a lower end 52 positioned to press against the sidewall 20 of the tubular support member 12 or the base 24 below the opening 26 formed therein when the manipulation portion 38 is actuated outward into the second position, as illustrated in FIG. 3. The restraining portion 38 may be configured to flex slightly when the manipulation portion 36 is actuated into the second position and the sidewall 20 of the hollow tubular support member 12 or the hollow central tube 28 of the base 24 may prevent the lower end 52 of the restraining portion 38 from rotating along with the rest of the ball release tab 16. Thus, when the manipulation portion 36 is released, as illustrated in FIG. 4, the opposing force of the restraining portion 38 pressing against the sidewall 20 or the hollow central tube 28 of the base 24 forces the ball release tab 16 back into the first position.

Figure 9:
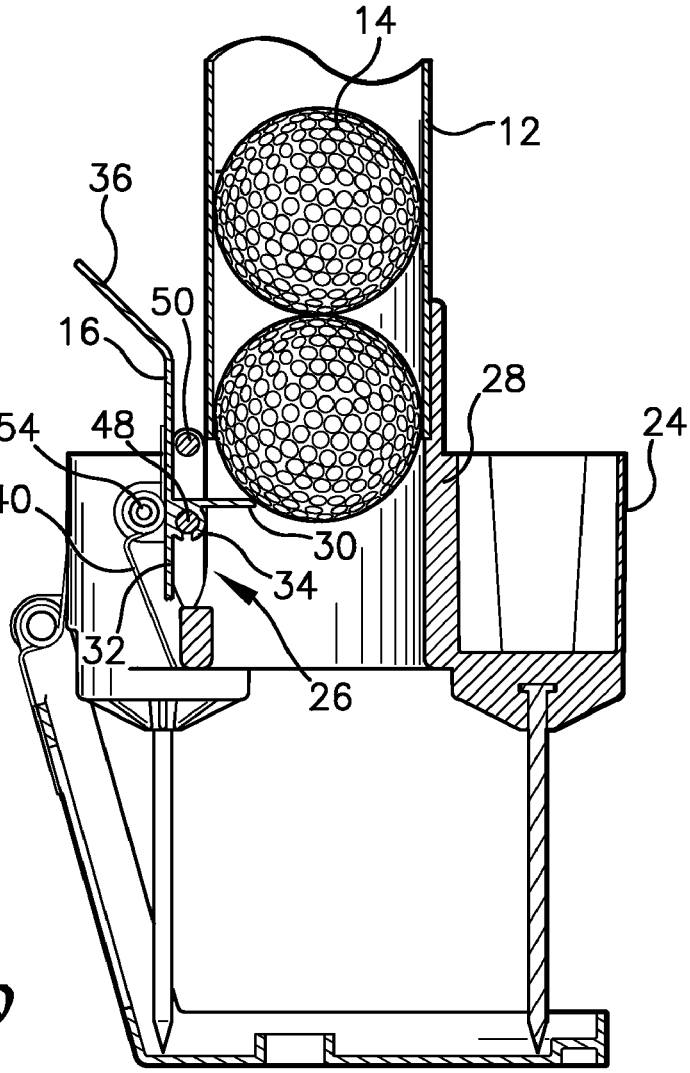
FIG. 9 is a fragmentary cross-sectional view of an alternative embodiment of the golf ball carrying apparatus with an alternatively-configured golf ball release tab.

In an alternative embodiment of the invention, as illustrated in FIG. 9, the restraining portion 38 of the ball release tab 16 may be omitted and the biasing spring 40, such as a torsion spring or other suitable resilient member, may be configured and positioned to bias the ball release tab 16 in the first position. For example, the biasing spring may be a resilient wire loosely wrapped around a spring-supporting rod 54 located proximate to the pivot joint 34. One end of the resilient wire may rest against the manipulation portion 36 of the ball release tab 16, while the other end of the resilient wire rests against the sidewall 20 of the hollow tubular support member 12 or the base 24 below the opening 26 formed therein.

In use, the ball release tab 16 may be actuated by a user from the first position to the second position and then released back to the first position in order to dispense one or more balls from the tubular support member 12. For example, when the manipulation portion 36 is actuated from the first position to the second position, the first stopper portion 30 may rotate away from the open end 22 until it no longer impedes the balls 14 from sliding out of the hollow tubular support member 12. Simultaneously, the movement of the manipulation portion 36 from the first position to the second position may rotate the second stopper portion 32 inward, causing it to impede the balls 14 from exiting through the open end 22 of the hollow tubular support member 12 in the second position.

As the manipulation portion 36 is released from the second position and begins to rotate back toward the first position, as illustrated in FIG. 4, the second stopper portion 32 may move back into its first position, thus releasing the pre-determined number of balls 14, while the first stopper portion 30 moves back into its first position, impeding the remaining balls 14 from exiting through the open end 22. For example, a first ball resting on the second stopper portion 32 may begin to slide downward as the second stopper portion 32 moves back to its first position. Simultaneously, a second ball formerly resting on the first ball may be impeded by the first stopper portion 30 as it returns to the first position, preventing the second ball from sliding out of the open end 22 along with the first ball once the second stopper portion 32 is in the first position.

Notice that the number of balls 14 released by moving the manipulation portion 36 from the first position to the second position and then releasing it back into the first position is dependent on the angle between the first and second stopper portions 30,32 and/or the length of the first and second stopper portions 30,32. For example, at a first distance between an end of the first stopper portion 30 and an and of the second stopper portion 32, the actuation of the ball release tab 16 may only release one ball to exit the hollow tubular support member 12. However, increasing the angle between the stopper portions 30,32 may result in the ends of the first and second stopper portions 30,32 being spaced apart by a second distance, such that the actuation of the ball release tab 16 may release two of the balls 14 to exit the hollow tubular support member 12 when the ball release tab 16 is actuated from the first position to the second position and then released back to the first position.

To load the balls 14 into the hollow tubular support member 12, the balls 14 may be pushed through the open end 22 such that the balls 14 each contact the first stopper portion 30 of the ball release tab 16, thereby pushing the first stopper portion 30 outward and temporarily out of the way as each of the balls 14 is loaded. Alternatively, another opening formed in the hollow tubular support member 12 may be configured to allow the balls 14 to be loaded therethrough.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A golf ball carrier, comprising:

a hollow tubular support member having at least one open end and configured to hold a plurality of golf balls stacked axially therein;

a base attached to the hollow tubular support member at or near the open end of the hollow tubular support member, wherein the base comprises a hollow central tube axially aligned with the hollow tubular support member and having one or more sidewalls with an opening formed therein;

a ladder having at least one vertical portion fixedly attached to the base proximate the opening formed therein and having at least one lateral portion; and a ball release tab rotatably attached to the ladder, wherein the ball release tab is biased in a first position relative to the base, and operable to rotate to a second position relative to the base, the ball release tab including:

a first stopper portion configured to extend into the hollow central tube in the first position and configured to extend outward of the hollow central tube in the second position, a second stopper portion fixed to the first stopper portion and configured to extend outward of the hollow central tube in the first position and configured to extend into the hollow central tube in the second position, a manipulation portion positioned outward of the hollow central tube and configured to actuate the ball release tab from the first position to the second position when pulled in a direction away from the hollow central tube, and a pivot joint rotatably attached to the lateral portion of the ladder, wherein the first stopper portion, the second stopper portion, and the manipulation portion each extend in different directions from the pivot joint, wherein an angle between the first and second stopper portions and a length of each of the first and second stopper portions is such that when the ball release tab is actuated from the first position to the second position and then back to the first position, only one golf ball is released from the hollow tubular support member.

2. The golf ball carrier of claim 1, wherein the ball release tab has a restraining portion located outward of the hollow central tube, positioned to contact a portion of the base and to resist rotation of the ball release tab from the first position to the second position.

3. The golf ball carrier of claim 1, further comprising a biasing spring coupled with the ball release tab and configured to resist rotation of the ball release tab from the first position to the second position.

4. The golf ball carrier of claim 1, wherein the ladder comprises two lateral portions, including one lateral portion about which the ball release tab rotates and another lateral portion configured to limit outward rotation of the first stopper portion in the second position.

* * * * *